US011685575B2

(12) United States Patent
Dreyer et al.

(10) Patent No.: US 11,685,575 B2
(45) Date of Patent: Jun. 27, 2023

(54) CLOSURE

(71) Applicant: Obrist Closures Switzerland GmbH, Reinach (CH)

(72) Inventors: Lino Dreyer, Reinach (CH); Graeme Hood, Reinach (CH); Claude Benoit-Gonin, Saint-Georges-de-Reneins (FR); Jean-Yves Rognard, Saint-Georges-de-Reneins (FR); Axel Rognard, Saint-Georges-de-Reneins (FR)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 17/050,657

(22) PCT Filed: Apr. 26, 2019

(86) PCT No.: PCT/EP2019/060820
§ 371 (c)(1),
(2) Date: Oct. 26, 2020

(87) PCT Pub. No.: WO2019/207148
PCT Pub. Date: Oct. 31, 2019

(65) Prior Publication Data

US 2021/0188488 A1 Jun. 24, 2021

(30) Foreign Application Priority Data

| | | |
|---|---|---|
| Apr. 26, 2018 | (GB) | 1806855 |
| Oct. 1, 2018 | (GB) | 1816019 |
| Dec. 12, 2018 | (GB) | 1820203 |

(51) Int. Cl.
*B65D 41/34* (2006.01)
*B65D 55/16* (2006.01)

(52) U.S. Cl.
CPC ..... *B65D 41/3447* (2013.01); *B65D 55/16* (2013.01); *B65D 2401/20* (2020.05); *B65D 2401/30* (2020.05); *B65D 2401/35* (2020.05)

(58) Field of Classification Search
CPC ..... B65D 41/3447; B65D 55/16; B65D 2401/20; B65D 2401/30; B65D 2401/35; B65D 41/3428; B65D 41/34
(Continued)

(56) References Cited

U.S. PATENT DOCUMENTS 2,961,119 A * 11/1960 Leach ..... B65D 55/16 220/291
2,990,077 A * 6/1961 Van Baarn ..... B65D 43/169 215/256
(Continued)

FOREIGN PATENT DOCUMENTS

CN 1631740 A † 6/2005
CN 16317410 A 6/2005
(Continued)

OTHER PUBLICATIONS

Sep. 20, 2019—(WO) International Search Report and Written Opinion—Appl. No. PCT/EP2019/060820.
(Continued)

*Primary Examiner* — Jennifer Robertson
*Assistant Examiner* — Eric C Baldrighi
(74) *Attorney, Agent, or Firm* — Banner & Witcoff, Ltd.

(57) ABSTRACT

A tamper-evident closure comprising a cap and a retaining ring, the retaining ring is connected to the sidewall by a plurality of bridges, at least one of the bridges is frangible and at least one of the bridges is non-frangible whereby to form a link between the ring and the sidewall.

16 Claims, 13 Drawing Sheets

Figure 1:
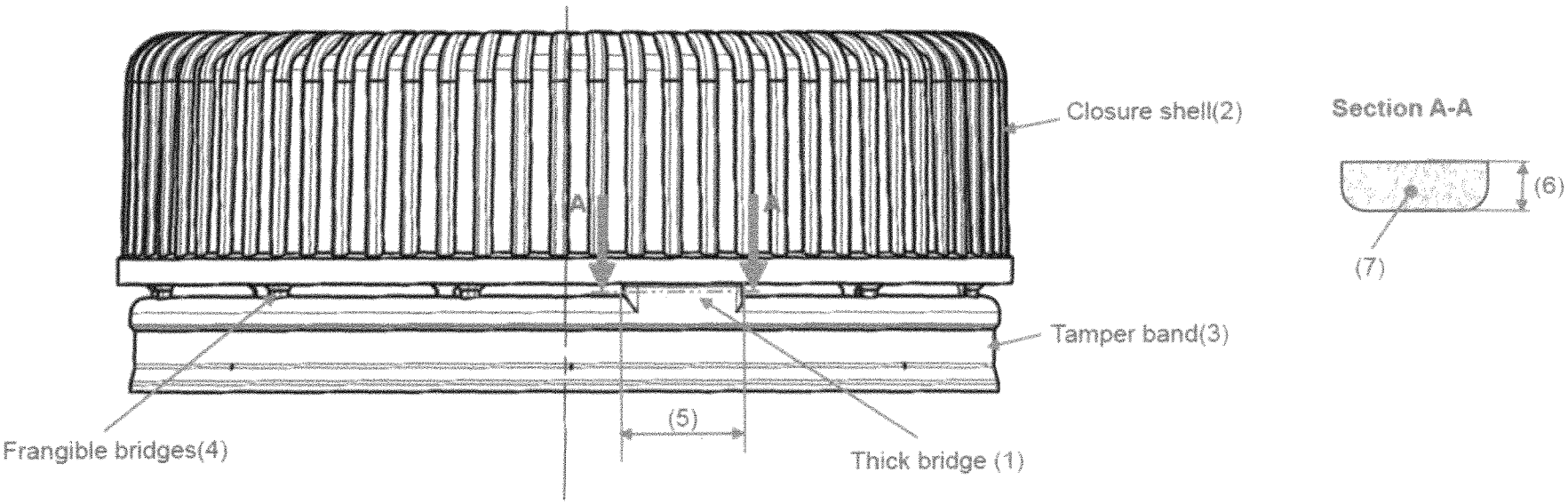

(58) Field of Classification Search
USPC ..... 215/250, 258
See application file for complete search history.

(56) References Cited

U.S. PATENT DOCUMENTS 4,394,918 A * 7/1983 Grussen ..... B65D 55/16 215/243
4,432,461 A * 2/1984 Mumford ..... B65D 41/3447 215/252
4,744,480 A * 5/1988 Luch ..... B65D 41/3447 215/901
4,805,792 A * 2/1989 Lecinski, Jr. ..... B65D 55/16 215/253
4,895,265 A * 1/1990 Luch ..... B65D 41/3447 215/901
4,904,435 A * 2/1990 Babcock ..... B26F 1/20 264/154
5,074,425 A * 12/1991 Wustmann ..... B65D 41/3447 215/252
5,215,204 A 6/1993 Beck et al.
5,295,600 A * 3/1994 Kowal ..... B65D 41/3428 215/252
5,836,468 A * 11/1998 Bosl ..... B65D 41/48 220/795
6,739,466 B1 * 5/2004 Culley ..... B65D 41/3428 215/901
7,513,377 B1 * 4/2009 Culley ..... B65D 41/3428 215/901
8,469,213 B2 * 6/2013 Ishii ..... B65D 41/325 215/252
2012/0285921 A1 11/2012 Kwon
2017/0240326 A1 * 8/2017 Rognard ..... B65D 47/0809

FOREIGN PATENT DOCUMENTS

FR 1183399 A 7/1959
FR 2499519 A1 8/1982
FR 3094353 A1 * 10/2020 ..... B65D 41/3442
FR 3106582 A1 * 7/2021 ..... B65D 41/3447
FR 3106583 A1 * 7/2021 ..... B65D 41/3428
JP 2001019002 A * 1/2001
JP 2006232392 A * 9/2006 ..... B65D 1/023
KR 100880006 B1 1/2009
KR 100942642 B1 2/2010
WO WO-0048920 A1 * 8/2000 ..... B65D 41/34
WO WO-2011093597 A2 * 8/2011 ..... B29C 45/33

OTHER PUBLICATIONS

Sep. 15 , 2021—Third Party Observation for application No. EP 20190722541.
Oct. 4, 2021—(EP) Examination Report—Appl. No. 19722541.0.
Jul. 4, 2022—(EP) Third-Party observations—App 19722541.0.
Jan. 3, 2023 (EP)—Office Action with Opposition Submission—App 19722541.0.

* cited by examiner
† cited by third party

CLOSURE

CROSS-REFERENCE TO RELATED APPLICATIONS

This application is a U.S. National Stage application under 35 U.S.C. § 371 of International Application PCT/EP2019/060820 (published as WO 2019/207148 A1), filed Apr. 26, 2019 which claims the benefit of priority to U.K. Application No. 1806855.1, filed Apr. 26, 2018, U.K. Application No. 1816019.2, filed Oct. 1, 2018, and U.K. Application No. 1820203.6 filed Dec. 12, 2018. Each of these prior applications is hereby incorporated by reference in their entirety.

The present invention relates generally to a tethered closure cap and particularly, although not exclusively to a tamper-evident tethered closure.

Arranged on the lower edge of the cap wall of closure caps of this type is a retaining ring that engages beneath a bead on a container mouth when the closure cap is in position. On opening the container, the upper cap portion can be removed from the container mouth to enable dispensing, while the lower retaining ring remains firmly connected to the container mouth.

An aspect of the present invention provides a tamper-evident closure comprising a cap and a retaining ring, the retaining ring is connected to the sidewall by a plurality of bridges, at least one of the bridges is frangible and at least one of the bridges is non-frangible whereby to form a link between the ring and the sidewall.

The cap may comprise a top plate and a side wall depending from the periphery thereof, the retaining ring is arranged beneath the side wall.

In some embodiment the non-frangible bridge/s can serve as a hinge between the cap and the ring.

The non-frangible bridge/s may be longer, circumferentially, than the frangible bridge/s.

The width of the or each non-frangible link may be in the range 2 mm to 10 mm e.g. 6-7 mm.

Some aspects and embodiments relate to and/or are in combination with a short neck finish. For the purposes of this specification, a "short" neck finish can be defined as anything having a ratio, when calculated as the finish height (measured between the underneath of a transfer bead and the top of the finish referring to "D" dimension according to technical bottle neck drawing nomenclature in use within the beverage industry) divided by the diameter of the thread crest referring to "T" dimension according to technical bottle neck drawing nomenclature in use within the beverage industry, of 0.35 or below.

In some embodiments the closure consists of only one non-frangible bridge. In other embodiments, for example, two or more non-frangible bridges may be used.

The or each non-frangible bridge may be formed as a strap.

In some embodiments the bridge/s are formed by slitting. Alternatively or additionally, bridge/s may be formed by moulding.

In some embodiments the closure is configured to have a stable docking position relative to a container.

The non-frangible bridge/s may cause local axial lifting of the ring when the cap is removed from a container neck in use. This may comprise a mechanical overslip of the band over a bottle bead or the like. It may be the case that there is no relative movement between the cap and the ring in the region of the bridge/s i.e. the movement of the cap is facilitated by plastic and/or elastic deformation of the ring.

The ring may be locally twisted by the non-frangible bridge/s when the cap is rotated in use.

The cap may be pivotable with respect to the ring by deformation of the ring.

The ring may be plastically and/or elastically deformable.

The cap may be pivotable with respect to the ring to provide a stable open position.

The cap may provide a tongue which is rotated when the ring is twisted and can engage with a container neck to hold the closure in a stable open position.

The ring may provide a tongue which is rotated when the ring is twisted and can engage with a container neck to hold the closure in a stable open position.

A further aspect provides a screw threaded beverage closure for a container mouth, comprising a cap and a retaining ring for retaining the closure on a container mouth, the ring is connected to the cap sidewall by a plurality of frangible bridges, and one or more non-frangible links are provided between the ring and the sidewall.

Also provided is a closure as described herein in combination with a container. The container may have a short neck finish.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims. Each aspect can be carried out independently of the other aspects or in combination with one or more of the other aspects.

The present invention will now be more particularly described, by way of example, with reference to the accompanying drawings.

The example embodiments are described in sufficient detail to enable those of ordinary skill in the art to embody and implement the systems and processes herein described. It is important to understand that embodiments can be provided in many alternative forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In the following description, all orientational terms, such as upper, lower, radially and axially, are used in relation to the drawings and should not be interpreted as limiting on the invention.

FIG. 1 shows a tamper-evident closure 10. The closure 10 includes a shell 2 and a tamper-evident band 3. The shell 2 has a circular top plate 8 and a side wall 9 depending from the periphery of the plate.

The band 3 is connected to the free end of the side wall 9 by a plurality of frangible bridges 4 and, in this embodiment, by a single thicker, non-frangible bridge 1.

The thick bridge 1 is designed so that the closure shell 2 remains connected on the tamper band 3, thereby allowing that after opening and reclosing in a normal use the closure remains attached on the container.

The plurality of frangible bridges 4 will get broken, indicating the evidence that the closure has been opened.

The "thick bridge" design is applicable to many different types of closures and products, for example for the beverage market e.g. flip-top sports caps and flat top caps.

In the embodiment shown here the number of thick bridges is one. In other embodiments two or more neighbouring thick bridges may be used.

The width 5 of the thick bridge in this embodiment is a minimum of 1.5 mm.

The thickness 6 of the bridge in this embodiment is a minimum of 0.5 mm.

Figure 2:
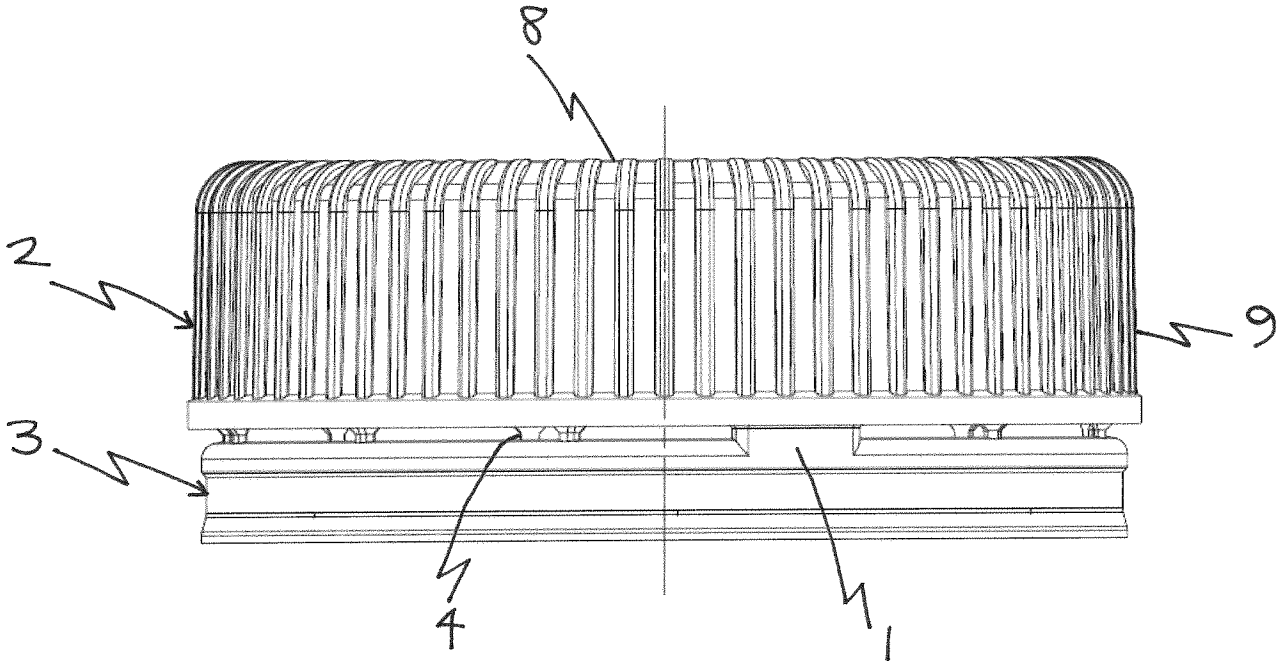
Figure 3:
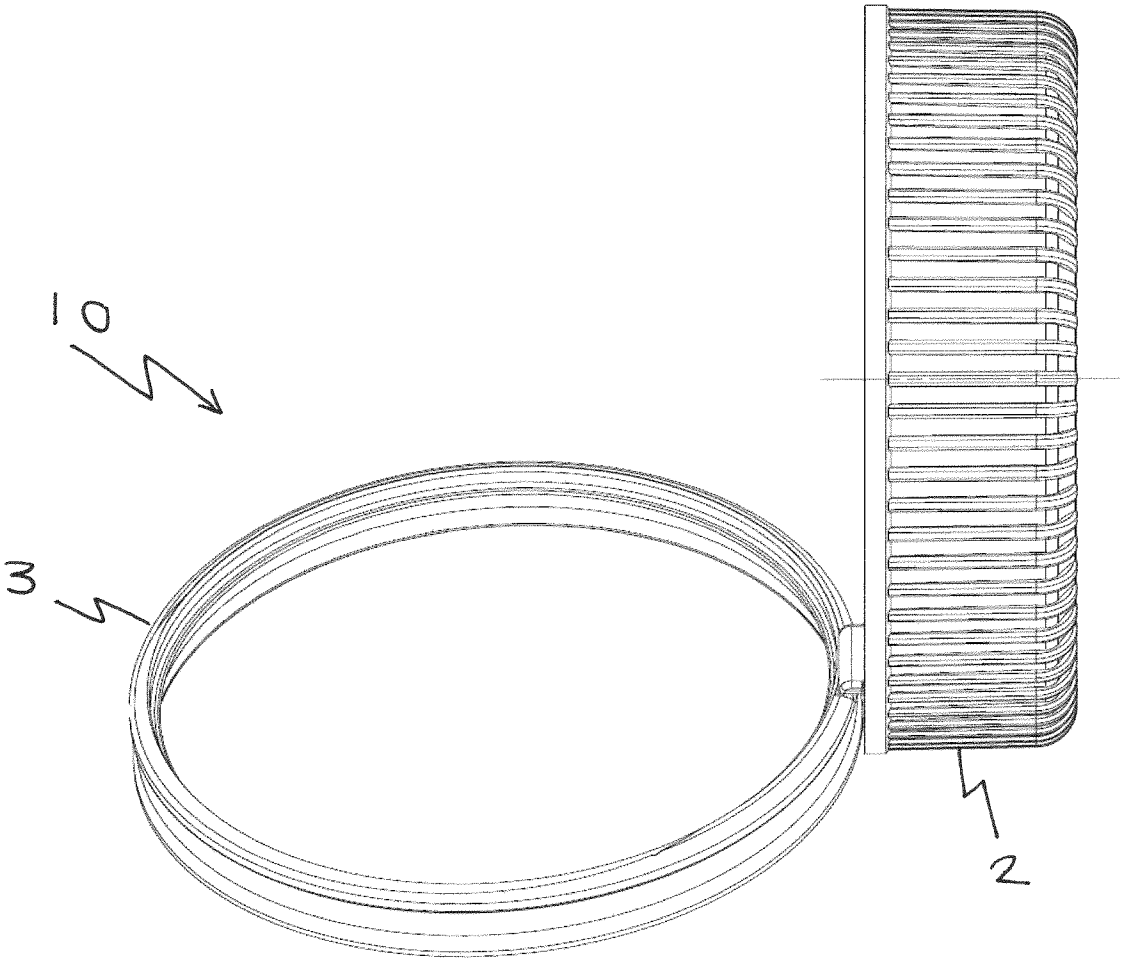
Figure 4:
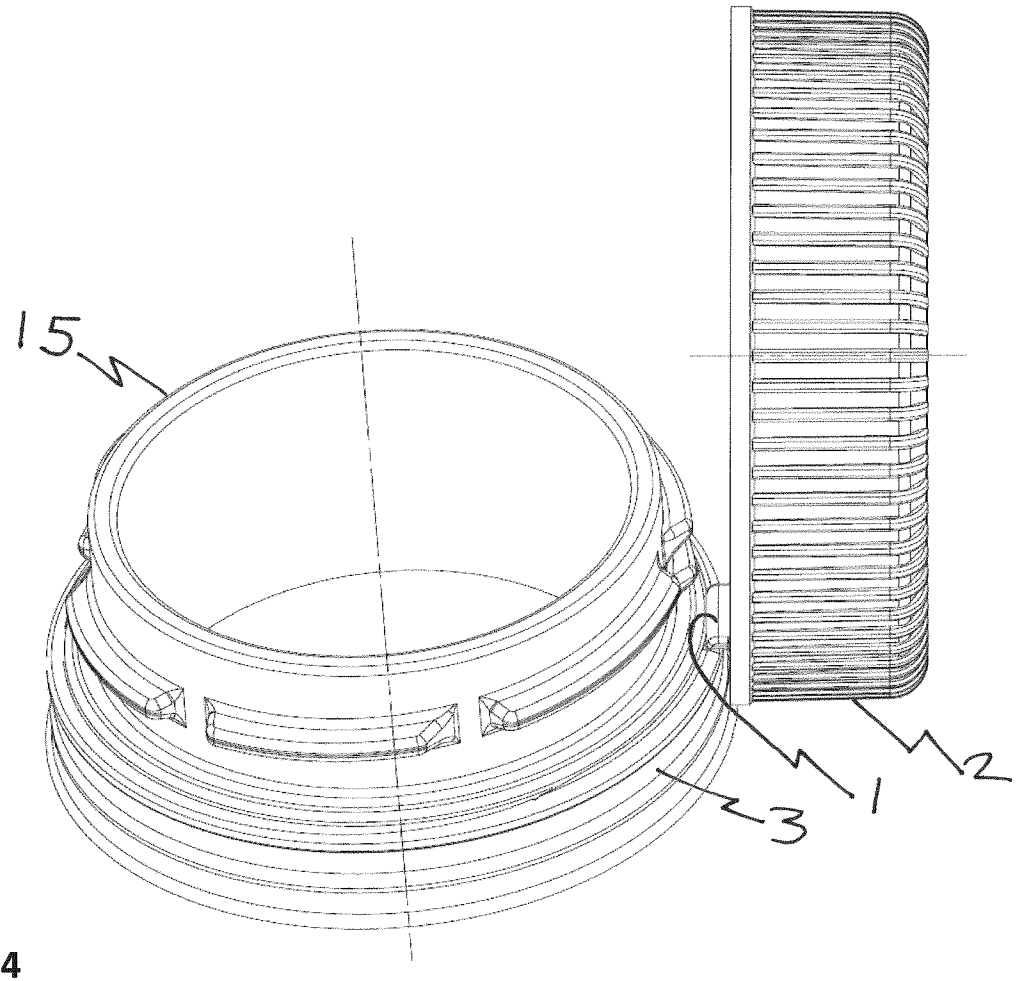

The closure 10 is shown in the closed, unopened position in FIG. 2. In FIG. 3 the closure 10 is shown in an opened position, in which the thicker bridge is shown to act like a hinge. In FIG. 4 the closure 10 is shown attached to a screw threaded container neck 15. It will be seen that the band 3 remains on the neck whilst the cap shell 2 is unscrewed and then pivoted.

Figure 5:
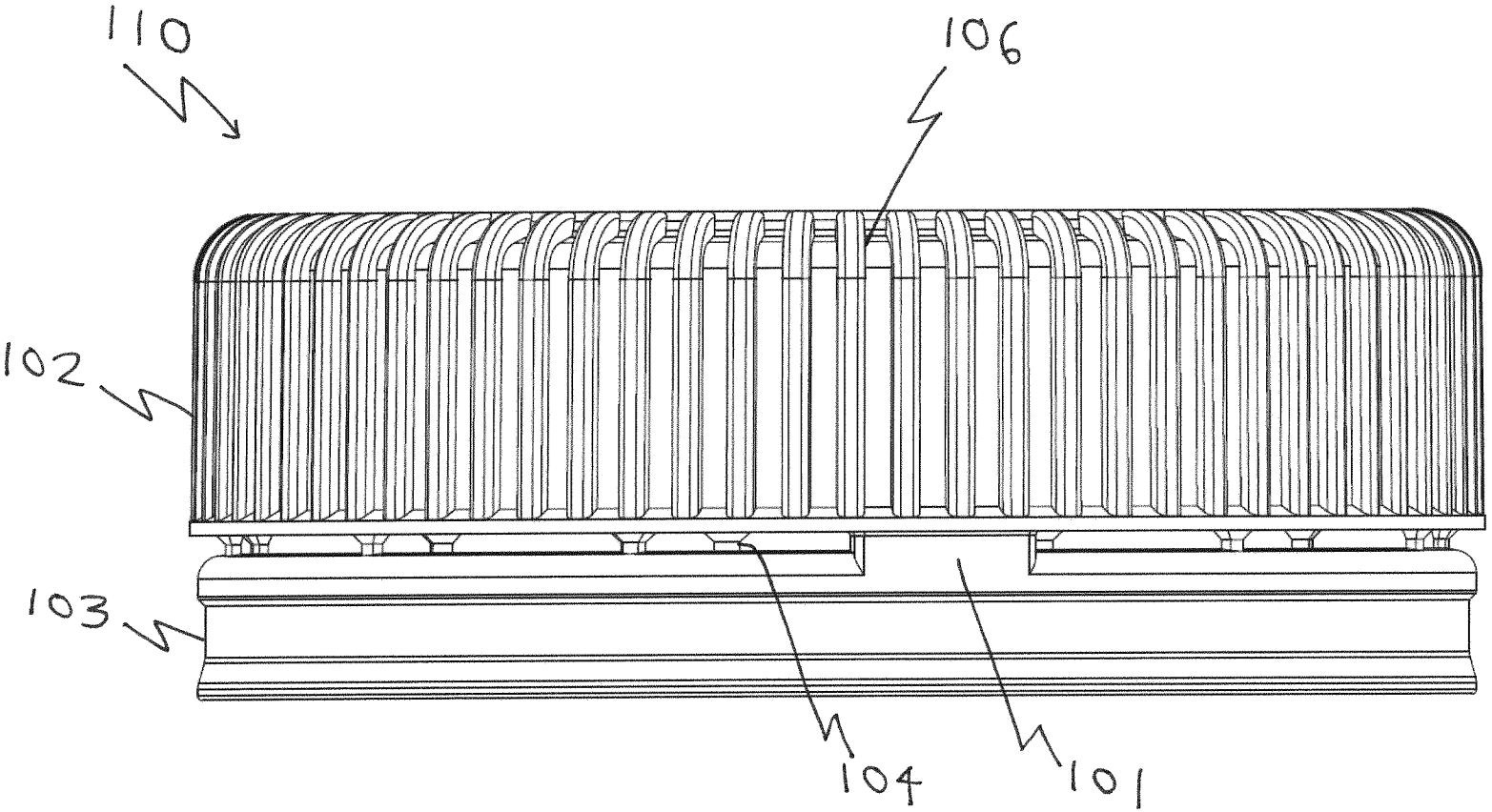

FIG. 5 shows a closure 110 formed according to a further embodiment.

The closure 110 is similar to the closure 10. It has a shell 102 connected to a band 103 initially by a plurality of frangible bridges 104 and also by a single thick bridge 101. The shell 102 has a plurality of axial ribs 106.

Figure 6:
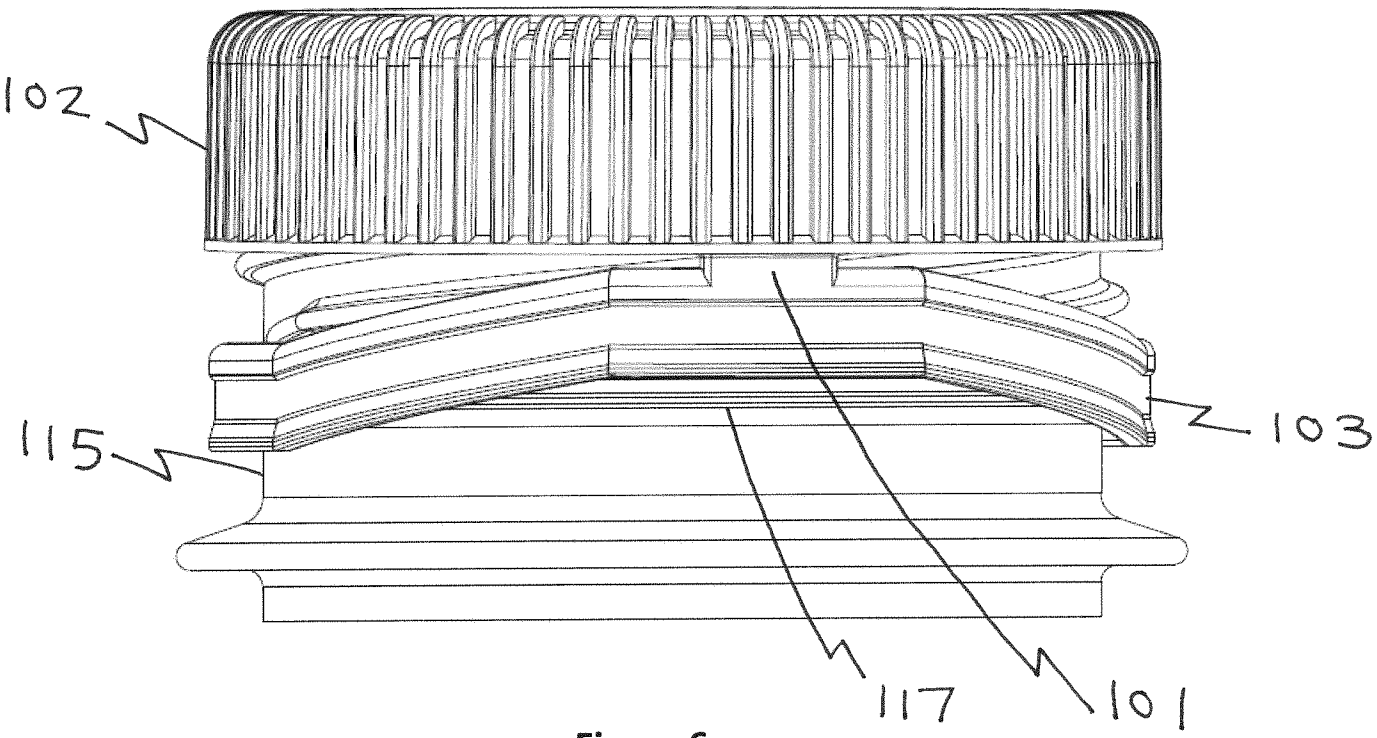
Figure 7:
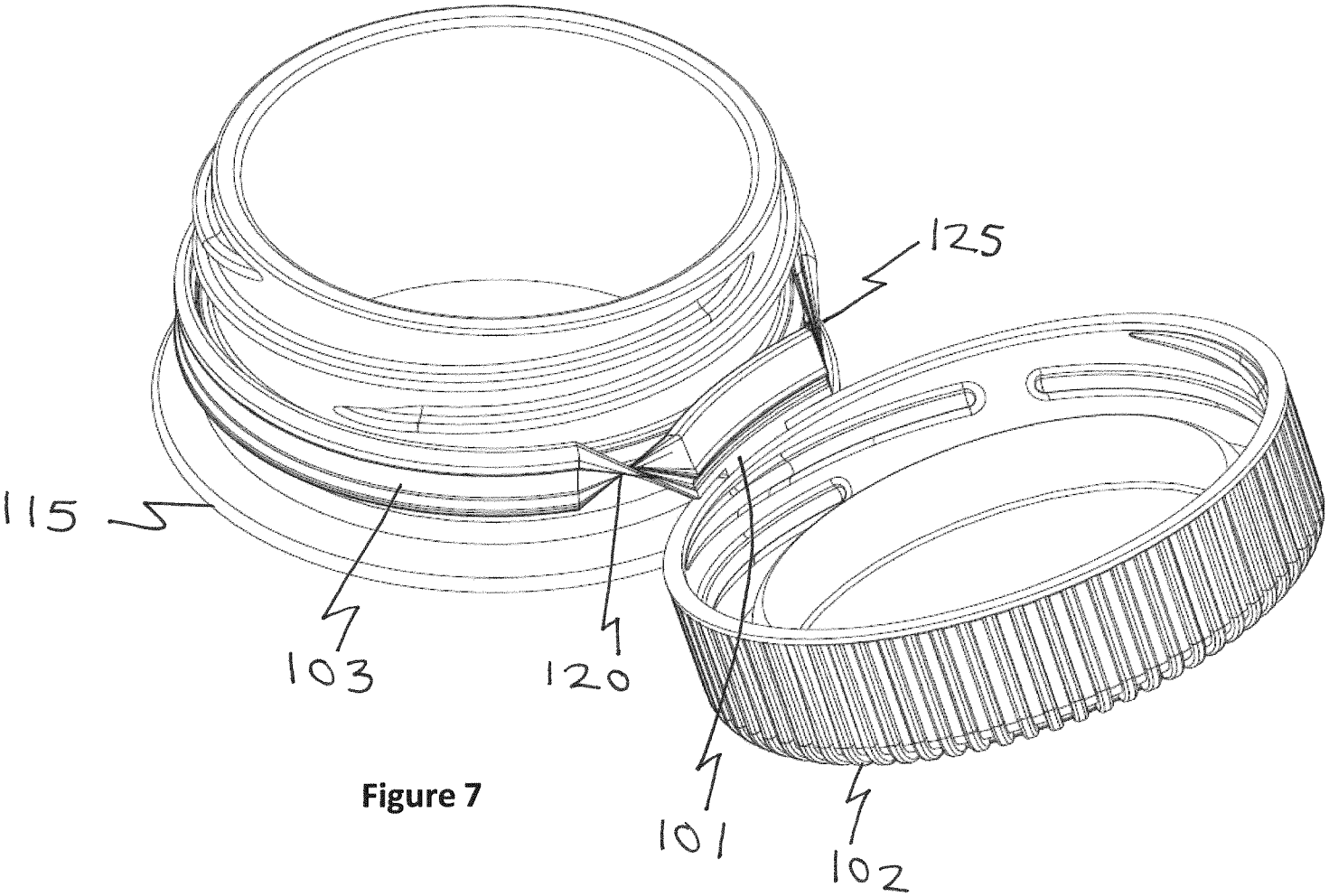
Figure 8:
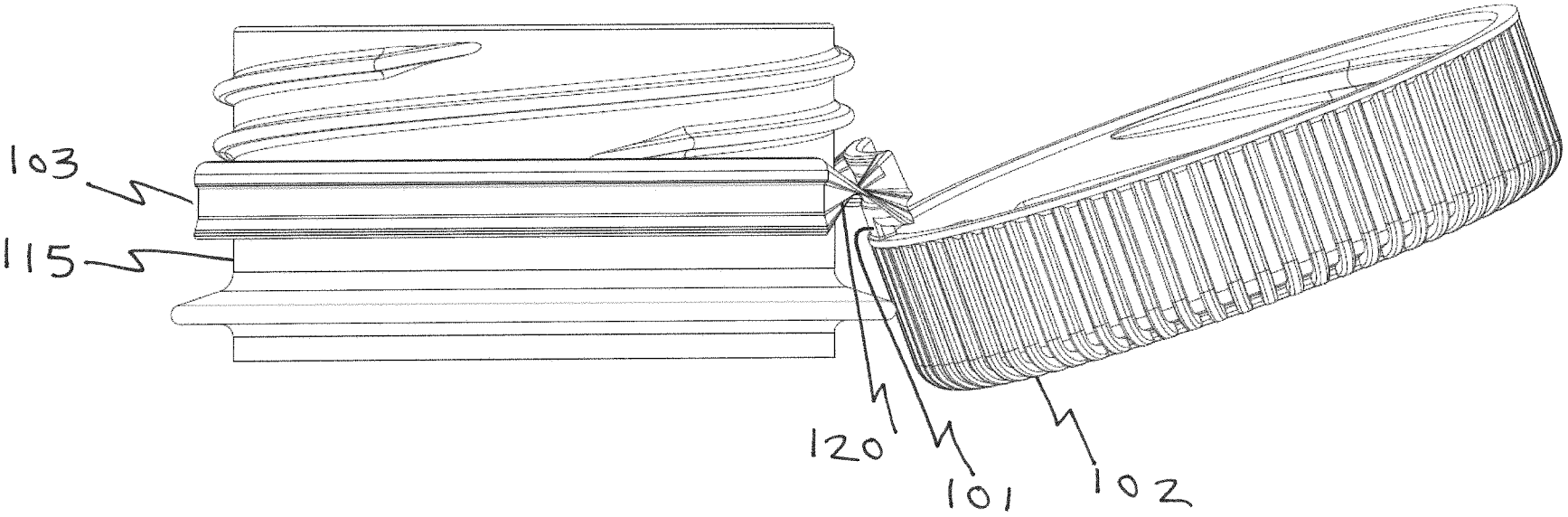
Figure 9:
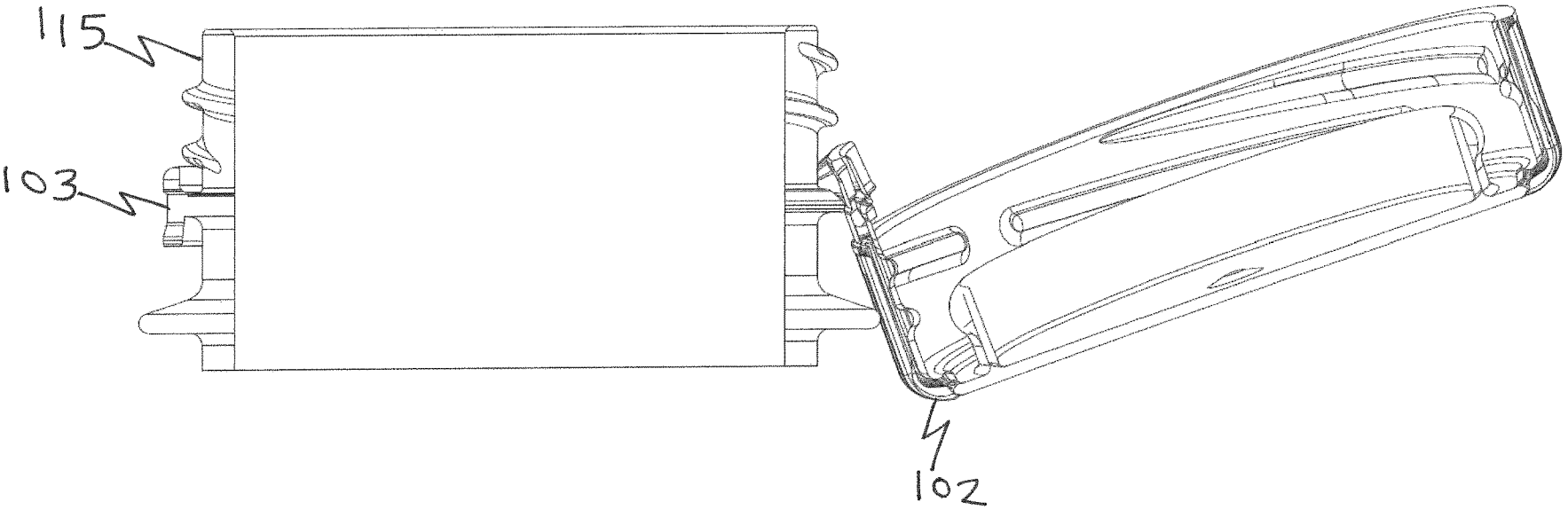
Figure 10A:
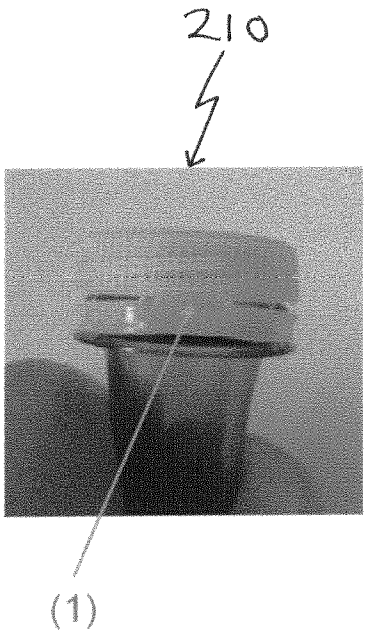
Figure 10B:
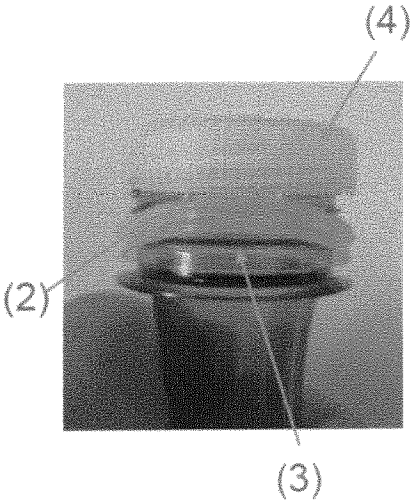
Figure 10C:
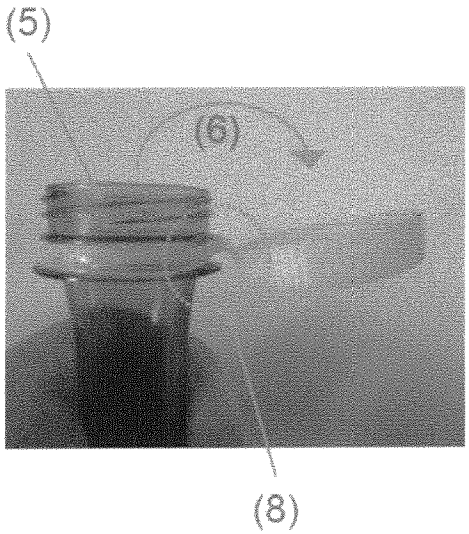
Figure 10D:
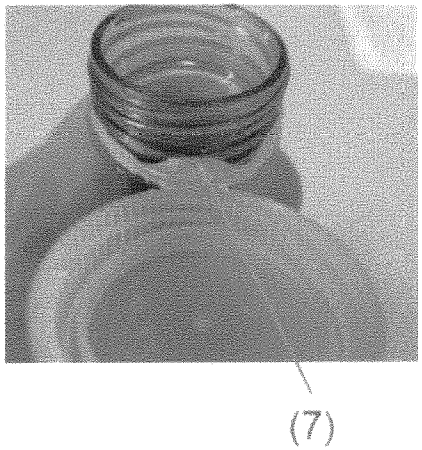

As can be seen in FIG. 6, when the cap shell 102 is unscrewed from the container neck 115 the presence of the strong, non-frangible bridge 101 causes part of the band 103 to be pulled up and over the neck retention bead 117. Once the screw threaded cap 102 is disengaged from the screw threaded neck 115, the cap can be flipped over as shown in FIGS. 7 to 9. As the cap flips, the bridge 101 causes the localised regions 120, 125 of the band 103 either side to twist as the shell is pivoted away. Thus the bridge itself is not a hinge, but it effectively creates a zone of pivoting/hinging by forcing the localised twisting of the band.

In FIGS. 10A to 10D a closure 210 formed according to a further embodiment is shown and provides a similar effect to the closure 110.

During opening, the strong "thick bridge" (1) pulls partially the tamper band ring (2) over the neck finish bead (3).

Once the closure shell (4) is disengaged from the neck finish thread (5), the consumer can flip back the closure into the open position (6).

When the consumer is pivoting the closure (4) to the open position (6), an appropriate definition of width and thickness of the thick bridge (1) will transmit a force into the tamper band ring (2), resulting in a rotation by torsion and thus creating local deformation (7) on the tamper band ring. This allows a stable docking position (8) against the neck finish secure bead (3).

The closure relies on deformation of tamper-evident band to pivot. This arrangement also provides a stable opening position by plastic deformation.

Figure 11:
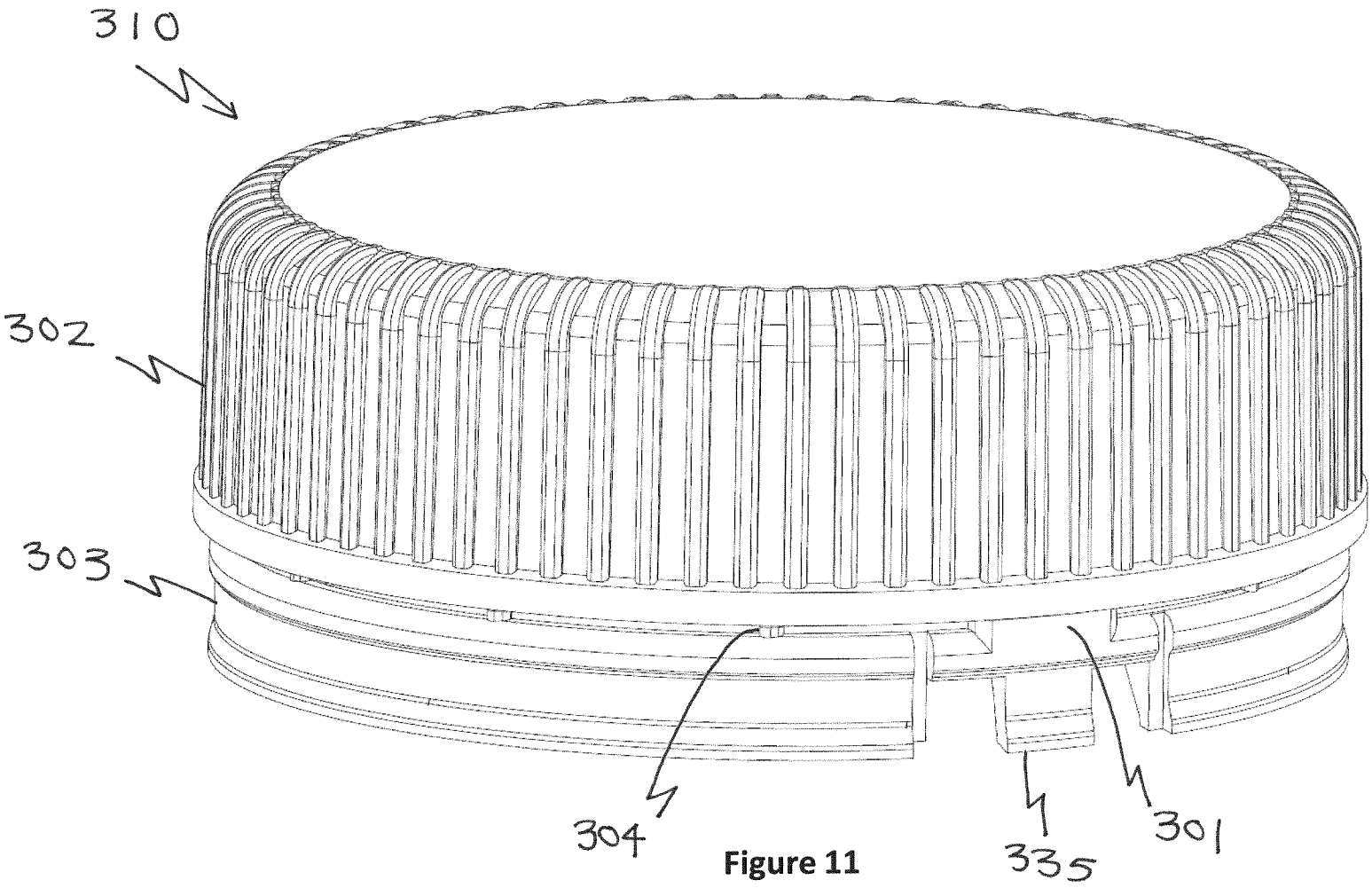

FIG. 11 shows a closure 310 formed according to a further embodiment.

The closure 310 comprises a top shell 302 and a tamper-evident band 303. The shell and band are connected by a plurality of frangible bridges 304. In one region a non-frangible bridge 301 is provided and connects the shell and band. In this region the band includes a depending tongue 335.

In use when the cap is unscrewed the cap lifts up and the bridge 301 pulls the band up locally (as described above). When the cap is then flipped over the band is locally twisted (as described above); and the tongue 335 rotates and sits on the container neck to provide a stable open position.

Figure 12:
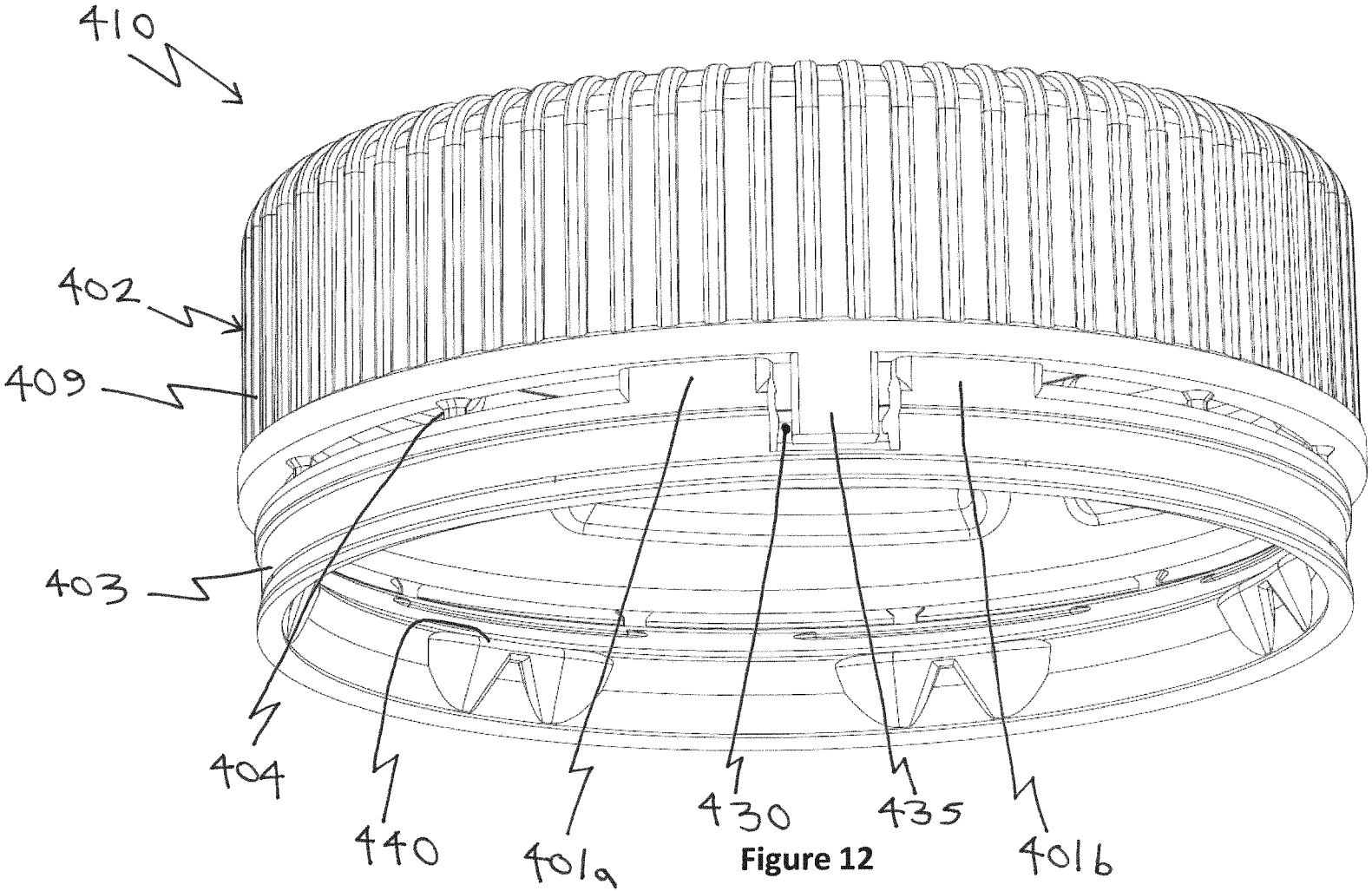

FIG. 12 shows a closure 410 formed according to a further embodiment.

The closure 410 comprises a top shell 402 and a tamper-evident band 403. The shell and band are connected by a plurality of frangible bridges 404. In one region a pair of neighbouring non-frangible bridges 401*a*, 401*b* are provided and connect the shell and band. Between the bridges 401*a*, 401*b* an opening 430 is provided in the band (it does not extend all the way to the bottom of the band) and a tongue 435 depends from the free end of the shell wall 409 into the opening. On the interior of the band a plurality of projections 440 are formed for engaging under a container neck retention bead.

In use when the cap is unscrewed the cap lifts up and the bridges 401*a*, 401*b* pull the band up locally (as described above). When the cap is then flipped over the band is locally twisted (as described above); and the tongue 435 is inverted and can engage the container neck to provide a stable open position. This could be considered as a "double root" version with a tongue.

Figure 14:
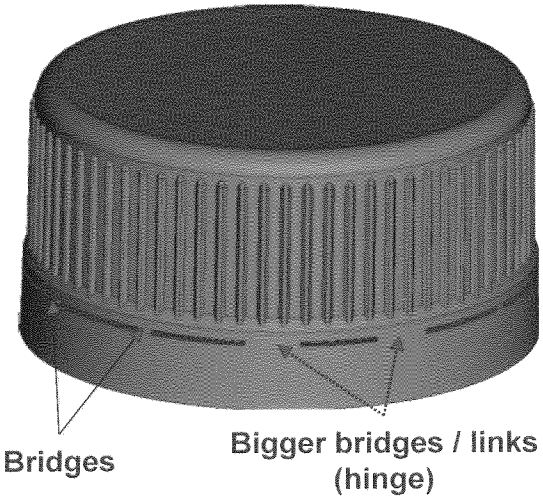
Figure 13:
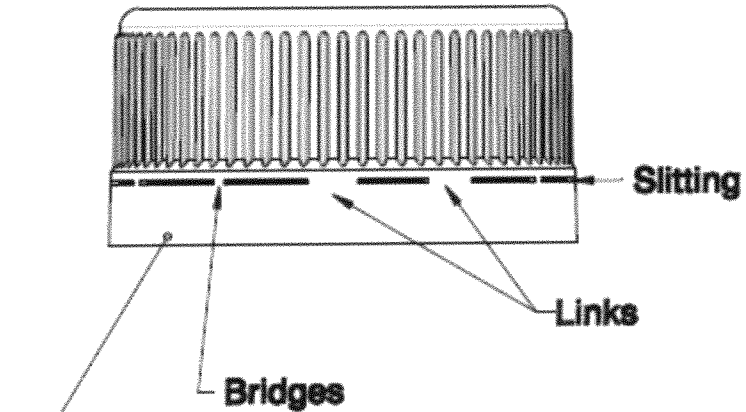
Figure 15:
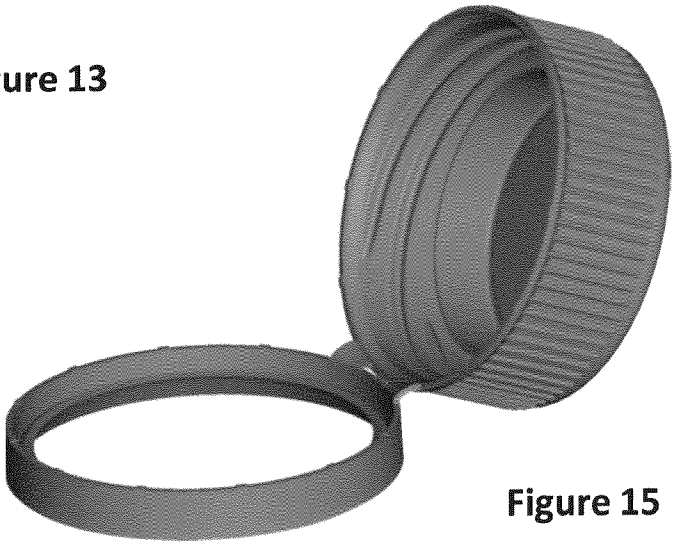

FIGS. 13 to 15 show a closure 510 formed according to a further embodiment.

The object of the closure 510 is to have a tethered cap to the bottle after opening it. The tamper-evident band, which stays on the neck of the bottle, is made by non-continuous cutting (slitting) plastic, which leaves several breakable elements (bridges) between the band and the cap. During the cutting operation of the band, instead of creating only breakable elements (bridges), wider sectors are spared to create one or more links that can serves as a hinge area upon opening of the cap as shown in FIG. 15.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A tamper-evident closure for a container neck including a retention bead, the closure comprising a screw threaded cap having a sidewall and a retaining ring having a circumference, a top edge, and a bottom edge, and the ring having a ring height extending between the top edge and the bottom edge, the retaining ring is arranged beneath the sidewall and is connected to the sidewall by a plurality of bridges, at least one of the bridges is frangible and only one of the bridges is non-frangible whereby to form a non-frangible link between the ring and the sidewall, wherein when the cap is unscrewed and lifts up, the non-frangible link causes a circumferential section of the ring to be pulled up locally and over the retention bead, wherein once the screw threaded cap is disengaged from the neck, the cap can be flipped over, wherein as the cap flips, the non-frangible link causes localised regions of the ring on either side of the non-frangible link to rotate, and thereby twist, about the circumference of the ring such that the twisting of the ring acts as the only hinge for pivoting of the cap, wherein the entire ring height of the circumferential section lifts and rotates.

2. The closure as claimed in claim 1, wherein the cap comprises a top plate, and the sidewall depends from a periphery thereof.

3. The closure as claimed in claim 1, wherein the non-frangible bridge is longer, circumferentially, than the frangible bridges.

4. The closure as claimed in claim 1, wherein the bridges are adjacent slits.

5. The closure as claimed in claim 1, wherein the bridges are molded.

6. The closure as claimed in claim 1, wherein the closure is movable to a stable open position.

7. The closure as claimed in claim 1, wherein the closure is movable to a stable docked position.

8. The closure as claimed in claim 1, wherein the sidewall is provided with a plurality of ribs.

9. The closure as claimed in claim 1, wherein the ring is plastically and/or elastically deformable.

10. The closure as claimed in claim 1, wherein the ring is plastically deformed to provide a stable open position.

11. The closure as claimed in claim 1, wherein the cap provides a tongue which is rotated when the ring is twisted and can engage with the container neck to hold the closure in a stable open position.

12. The closure as claimed in claim 1, wherein the ring provides a tongue which is rotated when the ring is twisted and can engage with the container neck to hold the closure in a stable open position.

13. The closure as claimed in claim 1, wherein there is no relative axial movement between the sidewall and the non-frangible bridge in the regions of the non-frangible bridge.

14. The closure as claimed in claim 1 in combination with a container.

15. The combination as claimed in claim 14, wherein the container has a short neck finish.

16. A tamper-evident closure and a container neck including a retention bead, the closure comprising a screw threaded cap having a sidewall and a retaining ring having a circumference, a top edge, and a bottom edge, and the ring having a ring height extending between the top edge and the bottom edge, the retaining ring is arranged beneath the sidewall and is connected to the sidewall by a plurality of bridges, at least one of the bridges is frangible and only one of the bridges is non-frangible to form a non-frangible link between the ring and the sidewall, wherein non-frangible link is configured to cause the ring to be pulled up locally and over the retention bead when the cap is unscrewed from the neck, wherein the cap is configured such that once the cap is disengaged from the neck, the cap can be flipped over, and wherein the non-frangible link is configured to cause localised regions of the ring either side of the non-frangible link to rotate about the circumference of the ring as the cap flips, whereby said localised regions are twisted such that the twisting of the ring acts as the only hinge for pivoting of the cap, wherein the entire ring height of the circumferential section lifts and rotates.

* * * * *